US008960289B2

(12) United States Patent
Zhang et al.

(10) Patent No.: US 8,960,289 B2
(45) Date of Patent: Feb. 24, 2015

(54) COMBINED FRACTURING AND PERFORATING METHOD AND DEVICE FOR OIL AND GAS WELL

(75) Inventors: Guoan Zhang, Xi'an (CN); Jianlong Cheng, Xi'an (CN); Xianhong Sun, Xi'an (CN)

(73) Assignee: Tong Oil Tools Co., Ltd., Xi'an (CN)

( * ) Notice: Subject to any disclaimer, the term of this patent is extended or adjusted under 35 U.S.C. 154(b) by 445 days.

(21) Appl. No.: 13/521,522

(22) PCT Filed: Nov. 10, 2010

(86) PCT No.: PCT/CN2010/078601

§ 371 (c)(1),
(2), (4) Date: Jan. 4, 2013

(87) PCT Pub. No.: WO2011/057564

PCT Pub. Date: May 19, 2011

(65) Prior Publication Data

US 2013/0098681 A1 Apr. 25, 2013

(30) Foreign Application Priority Data

Nov. 11, 2009 (CN) ..... 2009 1 0218911

(51) Int. Cl.
*E21B 43/11* (2006.01)
*E21B 43/263* (2006.01)
*E21B 43/117* (2006.01)
(Continued)

(52) U.S. Cl.
CPC ..... *E21B 43/263* (2013.01); *E21B 43/117* (2013.01); *F42B 1/02* (2013.01); *F42D 3/04* (2013.01)
USPC ..... 166/297; 175/4.6

(58) Field of Classification Search
USPC ..... 175/4.5, 4.6; 166/297, 298
See application file for complete search history.

(56) References Cited

U.S. PATENT DOCUMENTS 2,837,995 A 6/1958 Castel
2,980,017 A 4/1961 Castel
(Continued)

FOREIGN PATENT DOCUMENTS

CN 2270115 12/1997
CN 2309419 3/1999
(Continued)

OTHER PUBLICATIONS

Sep. 15, 2011 Office Action for CN 200910218911.0.
(Continued)

*Primary Examiner* — William P Neuder
(74) *Attorney, Agent, or Firm* — Law Offices of Albert Wai-Kit Chan, PLLC

(57) ABSTRACT

A combined fracturing and perforating method and device for oil and gas well are disclosed. The method utilizes an explosion of a perforating charge (5) in a combined fracturing perforator to ignite primary gunpowder in the perforator, and burning of the primary gunpowder ignites secondary gunpowder in the perforator. The body of the perforating gun in the combined fracturing and perforating device is provided with pressure releasing hole (8) which is directly facing the jet direction of said perforating charge, and sealing sheet (9) is arranged on said pressure releasing hole (8). Inner gunpowder box (6), which contains the primary gunpowder, and outer gunpowder box (7), which contains the secondary gunpowder, are mounted on the cylindrical charge frame (4).

19 Claims, 1 Drawing Sheet

(51) Int. Cl.
*F42B 1/02* (2006.01)
*F42D 3/04* (2006.01)

(56) References Cited

U.S. PATENT DOCUMENTS

| | | | | |
|---|---|---|---|---|
| 3,620,314 | A | 11/1971 | Bohn | |
| 4,191,265 | A | 3/1980 | Bosse-Platiere | |
| 4,253,523 | A | 3/1981 | Ibsen | |
| 4,627,353 | A | 12/1986 | Chawla | |
| 4,633,951 | A | 1/1987 | Hill et al. | |
| 4,683,943 | A | 8/1987 | Hill et al. | |
| 4,760,883 | A | 8/1988 | Dunn | |
| 4,823,875 | A | 4/1989 | Hill | |
| 4,976,318 | A | 12/1990 | Mohaupt | |
| 5,355,802 | A | 10/1994 | Petitjean | |
| 5,775,426 | A | 7/1998 | Snider et al. | |
| 5,885,321 | A | 3/1999 | Higa et al. | |
| 6,082,450 | A | 7/2000 | Snider et al. | |
| 6,186,230 | B1 | 2/2001 | Nierode | |
| 6,439,121 | B1 | 8/2002 | Gillingham | |
| 6,497,285 | B2 | 12/2002 | Walker | |
| 6,837,310 | B2 | 1/2005 | Martin | |
| 7,216,708 | B1 | 5/2007 | Bond et al. | |
| 7,913,761 | B2 | 3/2011 | Pratt et al. | |
| 2002/0134585 | A1 | 9/2002 | Walker | |
| 2002/0189802 | A1 | 12/2002 | Tolman et al. | |
| 2003/0037692 | A1 | 2/2003 | Liu | |
| 2003/0150646 | A1 | 8/2003 | Brooks et al. | |
| 2004/0129415 | A1 | 7/2004 | Xi et al. | |
| 2004/0216866 | A1 | 11/2004 | Barlow et al. | |
| 2005/0115441 | A1 | 6/2005 | Mauldin | |
| 2005/0139352 | A1 | 6/2005 | Mauldin | |
| 2006/0118303 | A1 | 6/2006 | Schultz et al. | |
| 2009/0078420 | A1 | 3/2009 | Caminari et al. | |
| 2009/0183916 | A1 | 7/2009 | Pratt et al. | |
| 2010/0258292 | A1 | 10/2010 | Tiernan et al. | |
| 2010/0276136 | A1 | 11/2010 | Evans et al. | |
| 2011/0240311 | A1 | 10/2011 | Robison et al. | |
| 2013/0098681 | A1 | 4/2013 | Zhang et al. | |
| 2013/0145924 | A1* | 6/2013 | Zhang et al. | 89/1.15 |
| 2013/0146287 | A1* | 6/2013 | Zhang et al. | 166/297 |
| 2013/0206385 | A1 | 8/2013 | Feng et al. | |

FOREIGN PATENT DOCUMENTS

| | | | |
|---|---|---|---|
| CN | 2314091 | | 4/1999 |
| CN | 2348095 | | 11/1999 |
| CN | 2376535 | | 5/2000 |
| CN | 2386194 | | 7/2000 |
| CN | 2391987 | | 8/2000 |
| CN | 2437852 | | 7/2001 |
| CN | 1312882 | | 9/2001 |
| CN | 2453132 | | 10/2001 |
| CN | 2485421 | | 4/2002 |
| CN | 2555393 | | 6/2003 |
| CN | 1143944 | | 3/2004 |
| CN | 2611593 | | 4/2004 |
| CN | 2628724 | | 7/2004 |
| CN | 2630491 | | 8/2004 |
| CN | 2630493 | | 8/2004 |
| CN | 2653125 | | 11/2004 |
| CN | 2682199 | | 3/2005 |
| CN | 2695631 | | 4/2005 |
| CN | 2818773 | | 9/2006 |
| CN | 2818774 | | 9/2006 |
| CN | 2821154 | | 9/2006 |
| CN | 2821154 | Y | 9/2006 |
| CN | 2846740 | | 12/2006 |
| CN | 2854071 | | 1/2007 |
| CN | 1916357 | | 2/2007 |
| CN | 2866810 | | 2/2007 |
| CN | 200968200 | | 10/2007 |
| CN | 201045293 | | 4/2008 |
| CN | 100491692 | | 5/2009 |
| CN | 201358768 | | 12/2009 |
| CN | 201396090 | | 2/2010 |
| CN | 201412133 | | 2/2010 |
| CN | 201531256 | | 7/2010 |
| CN | 201568033 | | 9/2010 |
| CN | 201568038 | | 9/2010 |
| CN | 201620848 | | 11/2010 |
| CN | 101952542 | | 1/2011 |
| CN | 102031952 | | 4/2011 |
| CN | 201843593 | | 5/2011 |
| CN | 102094613 | | 6/2011 |
| CN | 201865649 | | 6/2011 |
| CN | 201884014 | | 6/2011 |
| CN | 201934084 | | 8/2011 |
| CN | 201934084 | U | 8/2011 |
| CN | 201934086 | | 8/2011 |
| CN | 201991504 | | 9/2011 |
| CN | 202055812 | | 11/2011 |
| CN | 102410006 | | 4/2012 |
| CN | 102518419 | | 6/2012 |
| CN | 1690357 | | 7/2012 |
| CN | 202391399 | | 8/2012 |
| CN | 102011561 | | 4/2013 |
| CN | 102052068 | | 4/2013 |
| CN | 102022101 | | 7/2013 |
| WO | 02/063133 | | 8/2002 |
| WO | 2011057564 | | 5/2011 |
| WO | 2011057564 | A1 | 5/2011 |
| WO | 2012088984 | | 7/2012 |
| WO | 2012088985 | | 7/2012 |
| WO | 2013090647 | | 6/2013 |
| WO | 2013123268 | | 8/2013 |
| WO | 2013130166 | | 9/2013 |

OTHER PUBLICATIONS

Mar. 5, 2012 Office Action for CN 200910218911.0.
Jul. 6, 2013 2nd Office Action for CN 201010609790.5.
Jul. 11, 2013 1st Office Action for CN 201110426049.X.
Feb. 10, 2011 International Search Report for PCT/CN2010/078601.
Mar. 15, 2012 International Search Report for PCT/CN2011/083112.
Mar. 8, 2013 International Search Report for PCT/CN2011/083113.
Aug. 6, 2013 International Search Report for PCT/US2012/069606.
Feb. 28, 2013 International Search Report for PCT/US2012/069607.
Feb. 10, 2011 Written Opinion for PCT/CN2010/078601.
Mar. 15, 2012 Written Opinion for PCT/CN2011/083112.
Mar. 8, 2013 Written Opinion for PCT/CN2011/083113.
Aug. 6, 2013 Written Opinion for PCT/US2012/069606.
Feb. 28, 2013 Written Opinion for PCT/US2012/069607.
Zhang, 2009, "Mechanism Difference and Safety Analysis of Different Composite Perforators Types", Testing of Oil and Gas Wells, vol. 18(4), pp. 59-61.
Zhao, 2007, "Efficiency Monitoring, Comparison Analysis and Optimization of Composite Perforators", Well logging technology, vol. 31(1), p. 66-71.
Zhang et al., 1986, "Preliminary studies on high energy gas fracture", Journal of Xi'an Petroleum Institute, vol. 1 (2).
Liu et al., 2006, "Investigation on a composite perforator with in-built secondary synergistic effect", Conference paper of the fifth annual conference of the perforating branch of the Professional Committee of well testing in the Chinese Petroleum Society.
Yao et al., 2006, "Experimental investigation on the effect of a sleeve like gunpowder on the penetration depth of composite perforator", Conference on new developments in perforation technology by the perforating branch of the Professional Committee of well logging in the Chinese Petroleum Society.
Feng et al., 1996, "Analysis of the characteristics of two gunpowder charges in multi-pulse composite perforator and the process of fracturing", Explosive Materials, vol. 75 (4), 130-133.
Zhao et al., 2005, "On powder Burning Characteristics of Various Perforators", Well logging technology, vol. 30 (1) , 44-46.
Wang et al., 2002, "The current status and trends in combined perforating-fracturing techniques", Explosive materials, vol. 31 (3), 30-34.
Sun et al., 2007 "Review of combined perforating techniques", Explosive materials, vol. 36 (5).

(56) References Cited

OTHER PUBLICATIONS

Feng et al., 2005, "Investigation on multi-pulse perforation techniques", Explosive materials, vol. 34 (1), 32-36.
Zhu, 1993, "Developments of perforators outside China", Explosive Materials, vol. 75(4).
Nov. 22, 2012 Office Action for CN 201010809790.5.
Sep. 27, 2012 Office Action for CN 200910218911.0.
Apr. 16, 2014 Office Action for U.S. Appl. No. 13/814,243.
Jul. 8, 2014 Office Action for U.S. Appl. No. 13/814,243.
Jul. 16, 2014 Restriction Requirement for U.S. Appl. No. 13/759,064.
Jun. 25, 2014 Office Action for U.S. Appl. No. 13/814,242.

* cited by examiner

COMBINED FRACTURING AND PERFORATING METHOD AND DEVICE FOR OIL AND GAS WELL

This application is the national stage application of PCT/CN2010/078601, filed Nov. 10, 2010, which claims the priority of Chinese application No. 200910218911.0, filed Nov. 11, 2009. The entire contents and disclosures of the preceding applications are incorporated by reference into this application.

FIELD OF THE INVENTION

The present invention relates to method and device in the field of oil exploration, said method and device can deeply fracture a formation while perforating.

BACKGROUND OF THE INVENTION

In the field of oil and gas well exploration and exploitation, perforation is a key link in the completion of a well, and the degree of perfection of the perforation decides the productivity and lifespan of an oil and gas well. Shaped charge perforation is the common technique currently applied in perforation for oil and gas wells. Using simple shape charged perforation, a compaction zone of certain thickness is formed in the wall of the bore which leads to a drastic decrease in its permeability and severely impacts the productivity and lifespan of the oil and gas wells. To overcome this problem, the combined perforation technique was developed.

Combined perforation uses a combination of shape charged perforation and gunpowder. Upon the completion of perforation, gunpowder was used to deflagrate the gases generated at the stratum so as to remove any clogging contaminants, eradicate the compaction zone in the bore and achieve the aim of increasing both injection and productivity of the oil and gas wells. At present, most of the gunpowder is placed in guns for combined perforations in oil fields due to the simplicity of its construction, safety, reliability and little damage to the well bore. However, as the gunpowder had to be placed in shells in these combined perforator, the amount of gunpowder had to be drastically decreased, especially when space is limited at high hole density. This has led to poor results.

DESCRIPTION OF THE INVENTION

This invention provides a method and device for combined fracturing and perforation for oil and gas wells with improved energy efficiency, increased penetration depth and extended fissure length, thereby enhancing the effect of the fracturing.

In order to solve the technical problems mentioned above, the present invention provides a method for combined fracturing and perforation for oil and gas wells, comprising: ignition of primary gunpowder in the combined fracturing perforator using the explosion of the perforating charges in the combined fracturing perforator; ignition of secondary gunpowder in the perforator by burning of primary gunpowder; the time difference between the pressure peaks of the primary gunpowder and the secondary gunpowder is 5-10 milliseconds. The performance parameters of said primary gunpowder are heat of explosion from 3600 kJ/kg to 4200 kJ/kg and an impetus from 600 kJ/kg to 1100 kJ/kg; the performance parameters of said secondary gunpowder are heat of explosion from 2800 kJ/kg to 3400 kJ/kg and an impetus from 600 kJ/kg to 1100 kJ/kg.

This invention provides a combined fracturing and perforating device comprising a single perforator or a perforator made by joining of multiple perforators; said perforator has a perforating gun wherein a cylindrical charge frame is mounted; multiple perforating charges for shaped charge perforation are mounted on said cylindrical charge frame. The unique features of the invention are as follows: a gun body with a pressure releasing hole facing the exact direction of the perforating charge jet flow; a sealing sheet mounted on the pressure releasing hole; an inner gunpowder box and an outer gunpowder box mounted on the cylindrical charge frame, wherein the inner gunpowder box containing the primary gunpowder is mounted inside the cylindrical charge frame and placed between the adjacent shaped perforating charges; the outer gunpowder box containing the secondary gunpowder is mounted on the outer wall of the cylindrical charge frame. The proportion by weight of the components of said primary gunpowder is: 75-80% ammonium perchlorate and 20-25% hydroxyl-terminated polybutadiene making a sum of 100%. On this basis, additives comprising one or more kinds of curing agents, plasticizers, fire retardants and stabilizers that are well known in the art can be added. The performance parameters of said primary gunpowder are a heat of explosion from 3600 kJ/kg to 4200 kJ/kg and an impetus of 600 kJ/kg to 1100 kJ/kg. The proportion by weight of the components of said secondary gunpowder is: 75-80% ammonium perchlorate and 20-25% polyether making a sum of 100%. On this basis, additives comprising one or more kinds of curing agents, plasticizers, flame retardants and stabilizers that are well known in the art can be added. The performance parameters of said secondary gunpowder are a heat of explosion from 2800 kJ/kg to 3400 kJ/kg and an impetus of 600 kJ/kg to 1100 kJ/kg.

The method of loading said primary gunpowder and secondary gunpowder into a gun can increase the charge volume and extend the acting time of the pressure.

The sealing sheet is made of brittle materials, such as those sealing sheets made of powder metallurgical materials or alumina-zirconia ceramics.

The above pressure releasing hole is preferably a stepped hole with its small end located on the inner wall of said cylindrical charge frame, and the sealing sheet mounted on the step of the stepped hole. This aims to increase the burst height of the perforating charge, thereby increasing the depth of penetration of the perforating charge.

During perforation, the result of igniting the perforating charge with the detonating cord is to first cause the ignition of said primary gunpowder in the inner gunpowder box which then will ignite the secondary gunpowder in the outer gunpowder box on the outer wall of the charge frame. The time difference between the pressure peaks of the primary gunpowder and the secondary gunpowder is 5-10 ms. As the time difference between the pressure peaks of the primary gunpowder and the secondary gunpowder leads to energy complementation, the duration of the effective pressure developed in the bore is extended, the energy utilization is fully enhanced and the fissure length is elongated.

In the present invention, the primary gunpowder and the secondary gunpowder are respectively loaded into separate gunpowder boxes. This not only simplifies the assembly process, facilitates packaging and transportation but also improves safety. Such a structural configuration also facilitates the scaling-up and standardization of its production. By having the gun's pressure releasing hole directly facing the jet direction of said perforating charge, the deflagration gasses generated do not perform longitudinal and radial motion through the well bore annulus and are directly released to the perforation channel through the pressure releasing hole such that the energy loss of the deflagration gasses are reduced. This invention is applicable to field operation processes such as electric cables, drill stems or pipeline transportation.

DETAILED DESCRIPTION OF THE INVENTION

To better illustrate the present invention, preferred embodiments of this invention will be described in details below. It should be understood that these descriptions are merely illustrations of the unique features and advantages of the present invention and should not limit the scope of the invention described herein, which is defined by the claims which follow thereafter.

Detailed description of the invention is given below together with the figures.

Figure 1:
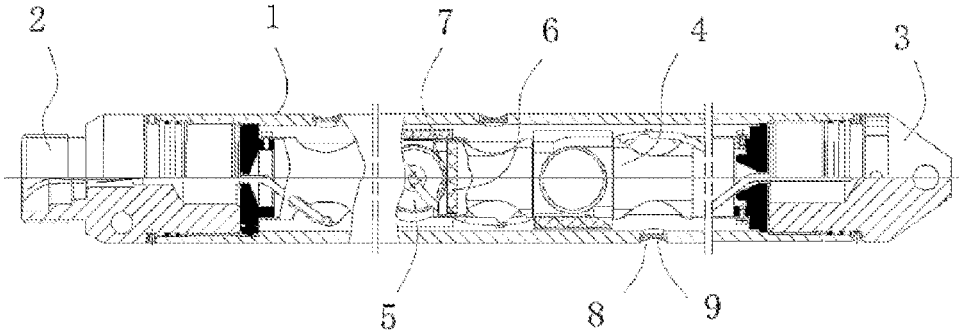
FIG. 1 shows the overall structure of the present invention.

As shown in FIG. 1, connector 2 is on the left of gun body 1 of the perforator while plug 3 is on its right. Multiple perforating charges 5 are mounted on cylindrical charge frame 4, with each of the perforating charges arranged spirally according to desired setting. Inner gunpowder box 6 is mounted inside cylindrical charge frame 4, and inner gunpowder box 6 is mounted between every two adjacent perforating charges; outer gunpowder box 7 is mounted outside cylindrical charge frame 4.

Figure 2:
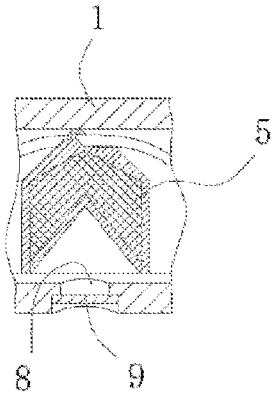
FIG. 2 shows part of the pressure releasing hole and sealing sheet on the gun body of perforator shown in FIG. 1.

As shown in FIG. 2, pressure releasing hole 8 is located in a position directly facing the projectile nose of the perforating charge on gun body 1, and sealing sheet 9 is fitted inside the pressure releasing hole 8. Pressure releasing hole 8 is designed as a stepped hole, and sealing sheet 9 is mounted on the step of the pressure releasing hole. Sealing sheet 9 is made of alumina-zirconia strengthened ceramics in which alumina accounts for 90-98% and zirconia accounts for 2-8; % by weight percentage, and said alumina-zirconia strengthened ceramics can also contain inevitable impurities. Powder metallurgical materials, such as sintered iron-base powder metallurgical materials, can also be used. This sealing sheet is completely broken up under the action of the perforating charge explosion, such that not only pollution to the well bore caused by steel sealing sheets can be eliminated, it also prevents possible gun jamming accidents caused by bridging effect during drop-down of the steel sealing sheets after perforation.

Figure 3:
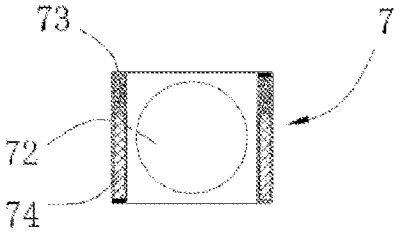
FIG. 3 shows the sectional view of the outer gunpowder box outside the charge frame shown in FIG. 1.
Figure 4:
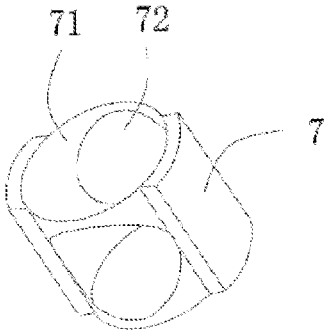
FIG. 4 shows a stereogram of the outer gunpowder box on the outer side of the charge frame shown in FIG. 1.

As shown in FIG. 3 and FIG. 4, the best mode for easy installation of said outer gunpowder box 7 is: connect two outer gunpowder boxes 7 as one piece or as two single subunits to form the outer gunpowder box subassembly. This outer gunpowder box subassembly possesses cylindrical gunpowder box frame 71 in which hole 72 is arranged for holding perforating charges. Two outer gunpowder boxes 7 are therefore located on the two sides of hole 72 in the cylindrical gunpowder box frame. During installation, it is only required to fit the outer gunpowder box subassembly one by one over the charge frame and is therefore simple and safe. Primary gunpowder is loaded into the inner gunpowder box while secondary gunpowder is loaded into the outer gunpowder box. This kind of integrated gunpowder box can be conveniently brought into assembly with charge frame, perforator and detonating cord. This gunpowder box configuration is also amendable to specific designs with variable hole densities and phase. The proportion by weight of the components of said primary gunpowder is: 75-80% ammonium perchlorate and 20-25% hydroxyl-terminated polybutadiene making a sum of 100%. On this basis, additives accounting for 1-2% by weight of said ammonium perchlorate and hydroxyl-terminated polybutadiene can be added. The additives comprise one or more kinds of the curing agents, plasticizers, fire retardants and stabilizers well known in the art. The performance parameters of said primary gunpowder are a heat of explosion from 3700 kJ/kg to 3900 kJ/kg and an impetus from 700 kJ/kg to 900 kJ/kg. The proportion by weight of the components of said secondary gunpowder is: 75-80% ammonium perchlorate and 20-25% polyether making a sum of 100%. On this basis, additives accounting for 1-2% of weight of ammonium perchlorate and polyether can be added. The additives comprise one or more kinds of the curing agents, plasticizers, fire retardants and stabilizers well known in the art. The performance parameters of said secondary gunpowder are a heat of explosion from 2900 kJ/kg to 3100 kJ/kg and an impetus from 900 kJ/kg to 1100 kJ/kg.

Example 1

In the combined fracturing perforator of this embodiment, sealing sheet 9 is made of alumina-zirconia strengthened ceramics that comprises 95% alumina and 3% zirconia (weight percentage).

The primary gunpowder mounted into the combined fracturing perforator includes 75% by weight of ammonium perchlorate and 25% by weight of hydroxyl-terminated polybutadiene; the secondary gunpowder includes 75% by weight of ammonium perchlorate and 25% by weight of polyether.

Figure 5:
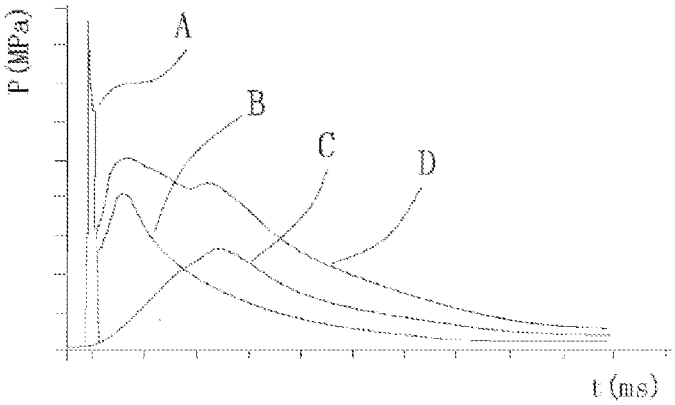
FIG. 5 shows the pressure curves from the perforating charge explosion, the burning of primary gunpowder and burning of secondary gunpowder from the present invention.

FIG. 5 shows the pressure curves from the perforating charge explosion, the burning of primary gunpowder and the burning of secondary gunpowder. As shown in the figure, curve A is the explosion pressure curve of the perforating charge, curve B is the pressure curve of burning primary gunpowder, curve C is the pressure curve of burning secondary gunpowder, and curve D is the superimposed burning pressure curve of primary gunpowder and secondary gunpowder. It could be observed that, due to the neatly timed difference between the pressure peaks of primary gunpowder and secondary gunpowder, the superimposed pressure dropped slowly and sustained relatively longer such that a continuous high-pressure state was maintained inside the bore. The acting time extended over twice that of ordinary combined gun perforation and, as a consequence, extended the fissure length.

As shown in FIG. 3, some of the secondary gunpowder 74 in outer gunpowder box 7 can be replaced by sand proppant 73. While the fissure is opened up under pressure, sand proppant will be carried into the fissure by high pressure gases to prop and prevent the closure of the fissure, thereby further increase the oil-gas flow and, hence, productivity. As per different gun perforation schemes, the outer gunpowder box 7 can be loaded with sand proppant 73 at its upper part and secondary gunpowder 74 at its lower part; or is loaded with sand proppant on one side and secondary gunpowder 74 on the other side; or some of the outer gunpowder boxes can be loaded fully with sand proppant.

Both inner and outer gunpowder boxes are made of inflammable materials, which can be fully combusted during gunpowder combustion without leaving any residues. The body of the gunpowder boxes is also effective in withstanding the shock waves generated by the perforating charge explosions and the explosive reactions caused by the direct action of high temperature on gunpowder, allowing the gunpowder to remain in a deflagration state throughout.

The method and device for combined fracturing and perforation for oil and gas wells provided by this invention have been described in details above, wherein, specific examples were presented to describe the principles and embodying methods of this invention. The above embodiments merely assist the understanding of the methods and core concepts of the present invention. It should be noted that, those skilled in the art can also make improvements and modifications to the present invention without deviating from its principle; however, such improvements and modifications also fall within the scope protected by the claims of this invention.

What is claimed is:

1. A device for combined fracturing and perforation for oil and gas wells, said device comprises one or more perforators, wherein said perforator has a perforating gun comprising (i) multiple perforating charges (5) mounted on a cylindrical charge frame (4) comprising an inner wall and an outer wall, wherein one or more inner gunpowder box (6) and one or more outer gunpowder box (7) are mounted on the cylindrical charge frame;

(ii) a gun body with pressure releasing hole (8) facing the direction of a perforating charge jet flow from said perforating charge; and (iii) a sealing sheet (9) mounted on the pressure releasing hole.

2. The device of claim 1, wherein the inner gunpowder box contains primary gunpowder and the outer gunpowder box contains secondary gunpowder.

3. The device of claim 1, wherein the inner gunpowder box is mounted inside the cylindrical charge frame and placed between adjacent perforating charges.

4. The device of claim 1, wherein the outer gunpowder box is mounted on the outer wall of the cylindrical charge frame.

5. The device of claim 1, wherein the sealing sheet is made of brittle materials.

6. The device of claim 1, wherein the pressure releasing hole is a stepped hole with a small end located on the inner wall of said cylindrical charge frame, and the sealing sheet is mounted on the step of the stepped hole.

7. The device of claim 1, wherein the primary gunpowder comprises about 75-80% by weight ammonium perchlorate, and about 20-25% by weight hydroxyl-terminated polybutadiene.

8. The device of claim 1, wherein the secondary gunpowder comprises about 75-80% by weight ammonium perchlorate, and about 20-25% by weight polyether.

9. The device of claim 1, wherein the primary or secondary gunpowder further comprises one or more additives selected from the group consisting of curing agents, plasticizers, fire retardants and stabilizers.

10. The device of claim 1, wherein two outer gunpowder boxes form an outer gunpowder box subassembly comprising a cylindrical gunpowder box frame (71) and holes (72) for holding perforating charges, wherein the two outer gunpowder boxes are located on the cylindrical gunpowder box frame adjacent to the holes.

11. The device of claim 10, wherein some of the secondary gunpowder in the outer gunpowder box is replaced by sand proppant.

12. The device of claim 11, wherein the upper and lower part of the outer gunpowder box is loaded with sand proppant and secondary gunpowder respectively.

13. The device of claim 11, wherein one outer gunpowder box is loaded with sand proppant, and the other gunpowder box is loaded with secondary gunpowder.

14. A method of using the device of claim 1 for combined fracturing and perforation of oil and gas wells, comprising the steps of:

igniting the primary gunpowder in the perforator by the explosion of the perforating charge to create at least one fissure; and igniting the secondary gunpowder in the perforator by combustion of the primary gunpowder, wherein the pressure peaks of the primary and secondary gunpowder explosions combine to maintain a high-pressure state and thereby extending the length of the fissure.

15. The method of claim 14, wherein a time difference exists between the pressure peaks of primary gunpowder and secondary gunpowder explosions, said time difference is 5-10 milliseconds.

16. The method of claim 14, wherein said primary gunpowder has a heat of explosion from about 3600 kJ/kg to 4200 kJ/kg and an impetus from about 600 kJ/kg to 1100 kJ/kg.

17. The method of claim 14, wherein said primary gunpowder has a heat of explosion from about 3700 kJ/kg to 3900 kJ/kg and an impetus from about 700 kJ/kg to 900 kJ/kg.

18. The method of claim 14, wherein said secondary gunpowder has a heat of explosion from about 2800 kJ/kg to 3400 kJ/kg and an impetus from about 600 kJ/kg to 1100 kJ/kg.

19. The method of claim 14, wherein said secondary gunpowder has a heat of explosion from about 2900 kJ/kg to 3100 kJ/kg and an impetus from about 900 kJ/kg to 1100 kJ/kg.

* * * * *